US007048812B2

(12) United States Patent
Bettles et al.

(10) Patent No.: US 7,048,812 B2
(45) Date of Patent: May 23, 2006

(54) CREEP RESISTANT MAGNESIUM ALLOY

(75) Inventors: Colleen Joyce Bettles, Glen Waverly (AU); Christopher Thomas Forwood, Croydon (AU)

(73) Assignee: Cast Centre Pty Ltd, Queensland (AU)

( * ) Notice: Subject to any disclaimer, the term of this patent is extended or adjusted under 35 U.S.C. 154(b) by 0 days.

(21) Appl. No.: 10/469,113

(22) PCT Filed: Jun. 20, 2003

(86) PCT No.: PCT/AU03/00774

§ 371 (c)(1),
(2), (4) Date: Jul. 22, 2004

(87) PCT Pub. No.: WO04/001087

PCT Pub. Date: Dec. 31, 2003

(65) Prior Publication Data

US 2005/0002821 A1 Jan. 6, 2005

(30) Foreign Application Priority Data

Jun. 21, 2002 (AU) ..... PS3112

(51) Int. Cl.
*C22C 23/06* (2006.01)
*C22F 1/06* (2006.01)

(52) U.S. Cl. ..... 148/420; 148/666; 148/667; 420/406; 420/411; 420/412

(58) Field of Classification Search ..... 420/406, 420/411, 412; 148/420, 666, 667
See application file for complete search history.

(56) References Cited

U.S. PATENT DOCUMENTS 3,687,135 A * 8/1972 Stroganov et al. ..... 606/72

FOREIGN PATENT DOCUMENTS

| | | |
|---|---|---|
| DE | 2313579 | * 9/1974 |
| FR | 2223471 | * 10/1974 |
| GB | 1378281 | 12/1974 |
| GB | 1463608 | 2/1977 |
| GB | 1527877 | 10/1978 |
| SU | 585940 | 2/1978 |
| SU | 1360223 | 10/1994 |

OTHER PUBLICATIONS

Mukhina I. Y; Lebedev, V.M.; Kim, K-H.; and Kim D-K, Investigation of the microstructure and properties of castable neodymium-and yttrium-bearing magnesium alloys at elevated temperatures, Science and heat treatment, vol. 39, 1997, pp 202-206.*

* cited by examiner

*Primary Examiner*—Sikyin Ip
(74) *Attorney, Agent, or Firm*—Rodman & Rodman

(57) ABSTRACT

A magnesium based alloy consists of, by weight: 1.4–1.9% neodymium, 0.8–1.2% rare earth element(s) other than neodymium, 0.4–0.7% zinc, 0.3–1% zirconium, 0–0.3% manganese, and 0–0.1% oxidation inhibiting element(s) the remainder being magnesium except for incidental impurities.

13 Claims, 4 Drawing Sheets

CREEP RESISTANT MAGNESIUM ALLOY

FIELD OF THE INVENTION

Figure 1:
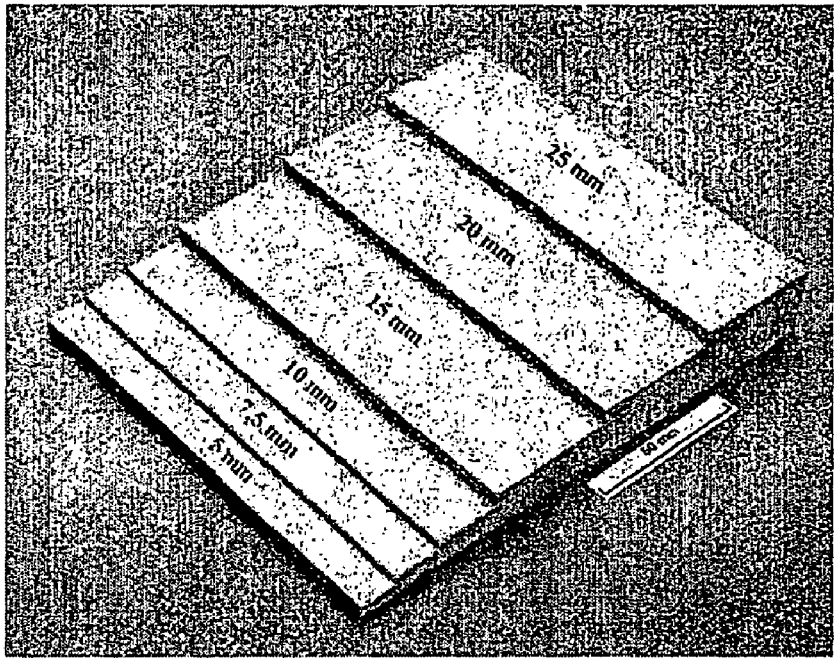

The present invention relates to magnesium (Mg) alloys and, more particularly, to magnesium alloys which are resistant to creep at high temperatures.

BACKGROUND TO THE INVENTION

Magnesium alloys have been used for many years in applications where the material of construction is required to exhibit a high strength to weight ratio. Typically a component made from a magnesium alloy could be expected to have a weight about 70% of an aluminium (Al) alloy component of similar volume. The aerospace industry has accordingly been a significant user of magnesium alloys and magnesium alloys are used for many components in modern defence aircraft and spacecraft. However, one limitation preventing wider use of magnesium alloys is that, when compared to aluminium alloys, they typically have poorer resistance to creep at elevated temperatures.

With the increasing needs to control international fuel consumption and reduce harmful emissions into the atmosphere, automobile manufacturers are being pressured into developing more fuel efficient vehicles. Reducing the overall weight of the vehicles is a key to achieving this goal. A major contributor to the weight of any vehicle is the engine itself, and the most significant component of the engine is the block, which makes up 20–25% of the total engine weight. In the past significant weight savings were made by introducing an aluminium alloy block to replace the traditional grey iron block, and further reductions of the order of 40% could be achieved if a magnesium alloy that could withstand the temperatures and stresses generated during engine operation was used. However, the development of such an alloy, which combines the desired elevated temperature mechanical properties with a cost effective production process, is necessary before a viable magnesium engine block manufacturing line could be considered. In recent years, the search for an elevated temperature magnesium alloy has focused primarily on the high pressure die casting (HPDC) processing route and several alloys have been developed. HPDC was considered to be the best option for achieving the high productivity rates required to counteract the probable high cost of the base magnesium alloy. However, HPDC is not necessarily the best process for the manufacture of an engine block and, in reality, the majority of blocks are still precision cast by gravity or low pressure sand casting.

There are two major classes of magnesium sand casting alloys.

(A) Alloys based on the magnesium-aluminium binary system, often with small additions of zinc (Zn) for improved strength and castability. These alloys have adequate room temperature mechanical properties, but do not perform well at elevated temperatures and are inappropriate at temperatures in excess of 150° C. These alloys do not contain expensive alloying elements and are widely used in areas where high temperature strength is not a requirement.

(B) Alloys able to be grain refined by the addition of zirconium (Zr). The major alloying elements in this group are zinc, yttrium (Y), silver (Ag), thorium (Th), and the rare earth (RE) elements such as neodymium (Nd). Throughout this specification the expression "rare earth" is to be understood to mean any element or combination of elements with atomic numbers 57 to 71, ie. lanthanum (La) to lutetium (Lu). With the right choice of alloying additions, alloys in this group can have excellent room and elevated temperature mechanical properties. However, with the exception of zinc, the alloying additions within this group, including the grain refiner, are expensive with the result that the alloys are generally restricted to aeronautical applications.

The magnesium alloy ML10, developed in the USSR, has been used for many years for cast parts intended for use in aircraft at temperatures up to 250° C. ML10 is a high strength magnesium alloy developed on the basis of the Mg—Nd—Zn—Zr system. ML19 alloy additionally contains yttrium.

A paper by Mukhina et al entitled "Investigation of the *Microstructure and Properties of Castable Neodymium and Yttrium-Bearing Magnesium Alloys at Elevated Temperatures*" published in "Science and Heat Treatment" Vol 39, 1997, indicated typical compositions (% by weight) of ML10 and ML19 alloys are:

| | ML10 | ML19 |
|---|---|---|
| Nd | 2.2–2.8 | 1.6–2.3 |
| Y | Nil | 1.4–2.2 |
| Zr | 0.4–1.0 | 0.4–1.0 |
| Zn | 0.1–0.7 | 0.1–0.6 |
| Mg | Balance | Balance |

with impurity levels of:

| | |
|---|---|
| Fe | <0.01 |
| Si | <0.03 |
| Cu | <0.03 |
| Ni | <0.005 |
| Al | <0.02 |
| Be | <0.01 |

Alternatives which have been developed are alloys known to those in the art as QE22 (an Mg—Ag—Nd—Zr system alloy) and EH21 (an Mg—Nd—Zr—Th system alloy). However, these alternatives are expensive to manufacture as they contain significant quantities of silver and thorium respectively.

Heat resistant grain refined magnesium alloys can be strengthened by a T6 heat treatment which comprises an elevated temperature solution treatment, followed by quenching, followed by an artificial aging at an elevated temperature. In heating before quenching the excess phases pass into solid solution. In the aging process refractory phases, in the form of finely dispersed submicroscopic particles, are segregated and these create microheterogeneities inside the grains of the solid solution, blocking diffusion and shear processes at elevated temperatures. This improves the mechanical properties, namely the ultimate long term strength and the creep resistance of the alloys at high temperature.

To date, a sand casting magnesium alloy having desired elevated temperature (eg 150–200° C.) properties at a reasonable cost has been unavailable. At least preferred embodiments of the present invention relate to such an alloy and the present invention is particularly, but not exclusively, directed to application with precision casting operations.

SUMMARY OF THE INVENTION

In a first aspect the invention provides a magnesium based alloy consisting of, by weight:

1.4–1.9% neodymium, 0.8–1.2% rare earth element(s) other than neodymium, 0.4–0.7% zinc, 0.3–1% zirconium, 0–0.3% manganese, and 0–0.1% oxidation inhibiting element(s), the remainder being magnesium except for incidental impurities.

In a second aspect, the present invention provides a magnesium alloy consisting of, by weight:

1.4–1.9% neodymium, 0.8–1.2% rare earth element(s) other than neodymium, 0.4–0.7% zinc, 0.3–1% zirconium, 0–0.3% manganese, 0–0.1% oxidation inhibiting element, no more than 0.15% titanium, no more than 0.15% hafnium, no more than 0.1% aluminium, no more than 0.1% copper, no more than 0.1% nickel, no more than 0.1% silicon, no more than 0.1% silver, no more than 0.1% yttrium, no more than 0.1% thorium, no more than 0.01% iron, no more than 0.005% strontium, the balance being magnesium except for incidental impurities.

Preferably, alloys according to the second aspect of the present invention:

(a) contain less than 0.1% titanium, more preferably less than 0.05% titanium, more preferably less than 0.01% titanium, and most preferably substantially no titanium;

(b) contain less than 0.1% hafnium, more preferably less than 0.05% hafnium, more preferably less than 0.01% hafnium, and most preferably substantially no hafnium;

(c) contain less than 0.05% aluminium, more preferably less than 0.02% aluminium, more preferably less than 0.01% aluminium, and most preferably substantially no aluminium;

(d) contain less than 0.05% copper, more preferably less than 0.02% copper, more preferably less than 0.01% copper, and most preferably substantially no copper;

(e) contain less than 0.05% nickel, more preferably less than 0.02% nickel, more preferably less than 0.01% nickel, and most preferably substantially no nickel;

(f) contain less than 0.05% silicon, more preferably less than 0.02% silicon, more preferably less than 0.01% silicon, and most preferably substantially no silicon;

(g) contain less than 0.05% silver, more preferably less than 0.02% silver, more preferably less than 0.01% silver, and most preferably substantially no silver;

(h) contain less than 0.05% yttrium, more preferably less than 0.02% yttrium, more preferably less than 0.01% yttrium, and most preferably substantially no yttrium;

(i) contain less than 0.05% thorium, more preferably less than 0.02% thorium, more preferably less than 0.01% thorium, and most preferably substantially no thorium;

(j) contain less than 0.005% iron, most preferably substantially no iron; and (k) contain less than 0.001% strontium, most preferably substantially no strontium.

Preferably, alloys according to the present invention contain at least 95% magnesium, more preferably 95.5–97% magnesium, and most preferably about 96.3% magnesium.

Preferably, the neodymium content is greater than 1.5%, more preferably greater than 1.6%, more preferably 1.6–1.8% and most preferably about 1.7%. The neodymium content may be derived from pure neodymium, neodymium contained within a mixture of rare earths such as a misch metal, or a combination thereof.

Preferably, the content of rare earth(s) other than neodymium is 0.9–1.1%, more preferably about 1%. Preferably, the rare earth(s) other than neodymium are cerium (Ce), lanthanum (La), or a mixture thereof. Preferably, cerium comprises over half the weight of the rare earth elements other than neodymium, more preferably 60–80%, especially about 70% with lanthanum comprising substantially the balance. The rare earth(s) other than neodymium may be derived from pure rare earths, a mixture of rare earths such as a misch metal or a combination thereof. Preferably, the rare earths other than neodymium are derived from a cerium misch metal containing cerium, lanthanum, optionally neodymium, a modest amount of praseodymium (Pr) and trace amounts of other rare earths.

The habit plane of the precipitating phase in Mg—Nd—Zn alloys is related to the zinc content, being prismatic at very low levels of Zn and basal at levels in excess of about 1 wt %. The best strength results are obtained at zinc levels which promote a combination of the two habit planes. Preferably, the zinc content is less than 0.65%, more preferably 0.4–0.6%, more preferably 0.45–0.55%, most preferably about 0.5%.

Reduction in iron content can be achieved by addition of zirconium which precipitates iron from molten alloy. Accordingly, the zirconium contents specified herein are residual zirconium contents. However, it is to be noted that zirconium may be incorporated at two different stages. Firstly, on manufacture of the alloy and secondly, following melting of the alloy just prior to casting.

The elevated temperature properties of alloys of the present invention are reliant on adequate grain refinement and it is therefore necessary to maintain a level of zirconium in the melt beyond that required for iron removal. For desired tensile and compressive strength properties the grain size is preferably less than 200 μm and more preferably less than 150 μm. The relationship between creep resistance and grain size in alloys of the present invention is counter-intuitive. Conventional creep theory will predict that the creep resistance will decrease as the grain size decreases. However, alloys of the present invention have shown a minimum in creep resistance at a grain size of 200 μm and improvements in creep resistance at smaller grain sizes. For optimum creep resistance the grain size is preferably less than 100 μm and more preferably about 50 μm. Preferably, the zirconium content will be the minimum amount required to achieve satisfactory iron removal and adequate grain refinement for the intended purpose. Typically, the zirconium content will be greater than 0.4%, preferably 0.4–0.6%, more preferably about 0.5%.

Manganese is an optional component of the alloy which may be included if there is a need for additional iron removal over and above that achieved by zirconium, especially if the zirconium levels are relatively low, for example below 0.5 wt %.

Elements which prevent or at least inhibit oxidation of molten alloy, such as beryllium (Be) and calcium (Ca), are optional components which may be included especially in circumstances where adequate melt protection through cover gas atmosphere control is not possible. This is particularly the case when the casting process does not involve a closed system.

Ideally, the incidental impurity content is zero but it is to be appreciated that this is essentially impossible. Accordingly, it is preferred that the incidental impurity content is less than 0.15%, more preferably less than 0.1%, more preferably less than 0.01%, and still more preferably less than 0.001%.

In a third aspect, the present invention provides a magnesium based alloy having a microstructure comprising equiaxed grains of magnesium based solid solution separated at the grain boundaries by a generally contiguous intergranular phase, the grains containing a uniform distribution of nano-scale precipitate platelets on more than one habit plane containing magnesium and neodymium, the intergranular phase consisting almost completely of rare earth elements, magnesium and a small amount of zinc, and the rare earth elements being substantially cerium and/or lanthanum.

The grains may contain clusters of small spherical and globular precipitates. The spherical clusters may comprise fine rod-like precipitates. The globular precipitates may be predominantly zirconium plus zinc with a Zr:Zn atomic ratio of approximately 2:1. The rod-like precipitates may be predominantly zirconium plus zinc with a Zr:Zn atomic ratio of approximately 2:1.

The expression "generally contiguous" as used in this specification is intended to mean that at least most of the intergranular phase is contiguous but that some gaps may exist between otherwise contiguous portions.

In a fourth aspect, the present invention provides a method of producing a magnesium alloy article, the method comprising subjecting to a T6 heat treatment an article cast from an alloy according to the first, second or third aspect of the present invention.

In a fifth aspect, the present invention provides a method of manufacturing a magnesium alloy article, the method comprising the steps of:

(a) solidifying in a mould a casting of an alloy according to the first, second or third aspects of the present invention, (b) heating the solidified casting at a temperature of 500–550° C. for a first period of time, (c) quenching the casting, and (d) ageing the casting at a temperature of 200–230° C. for a second period of time.

Preferably, the first period of time is 6–24 hours and the second period of time is 3–24 hours.

In a sixth aspect, the present invention provides a method of manufacturing a casting made from magnesium alloy comprising the steps of:

(i) melting an alloy according to the first, second or third aspects of the present invention to form a molten alloy, (ii) introducing the molten alloy into a sand mould or permanent mould and allowing the molten alloy to solidify, (iii) removing the resultant solidified casting from the mould, and (iv) maintaining the casting within a first temperature range for a first period of time during which a portion of an intergranular phase of the casting is dissolved, and subsequently maintaining the casting within a second temperature range lower than the first temperature range for a second period of time during which nano-scale precipitate platelets are caused to precipitate within grains of the casting and at grain boundaries.

The first temperature range is preferably 500–550° C., the second temperature range is preferably 200–230° C., the first period of time is preferably 6–24 hours, and the second period of time is preferably 3–24 hours.

In a seventh aspect, the present invention provides an engine block for an internal combustion engine produced by a method according to the fourth, fifth or sixth aspect of the present invention.

In an eighth aspect, the present invention provides an engine block for an internal combustion engine formed from a magnesium alloy according to the first, second or third aspects of the present invention.

Specific reference is made above to engine blocks but it is to be noted that alloys of the present invention may find use in other elevated temperature applications as well as low temperature applications.

DESCRIPTION OF PREFERRED EMBODIMENTS OF THE INVENTION

EXAMPLE 1

Samples were gravity cast from six alloy compositions (see Table 1) into a stepped plate mould having step thicknesses from 5 mm to 25 mm to form castings as illustrated in FIG. 1. The rare earths other than neodymium were added as a Ce-based misch metal which contained cerium, lanthanum and some neodymium. The extra neodymium and the zinc were added in their elemental forms. The zirconium was added through a proprietary Mg—Zr master alloy. Standard melt handling procedures were used throughout preparation of the cast plates. Individual samples were then subjected to T6 heat treatment no. 3 of Table 2 which was determined to provide the best results. The solution heat treatment was carried out in a controlled atmosphere environment to prevent oxidation of the surface layers during the heat treatment. The resulting heat treated samples were then examined and tested to determine hardness, tensile strength, creep properties, corrosion resistance, fatigue performance and bolt load retention behaviour. Details are as shown in Tables 1 and 2 below.

TABLE 1

Compositions Evaluated

| Composition No. | Wt % Zn | Wt % Nd | Wt % RE other than Nd | Wt % Zr | Wt % Total RE |
|---|---|---|---|---|---|
| Comparative - A | 0.42 | 1.40 | 1.33 | 0.47 | 2.73 |
| Comparative - B | 0.85 | 2.04 | 1.13 | 0.503 | 3.17 |
| Comparative - C | 0.88 | 1.68 | 0.82 | 0.519 | 2.50 |
| Inventive - 1 | 0.41 | 1.63 | 0.8 | 0.495 | 2.43 |
| Inventive - 2 | 0.67 | 1.64 | 0.81 | 0.459 | 2.45 |
| Inventive - 3 | 0.55 | 1.70 | 0.94 | 0.55 | 2.64 |

TABLE 2

T6 Heat Treatments Evaluated

| Heat Treatment No. | Solution Treatment | Quench Type | Ageing |
|---|---|---|---|
| 0 | 525° C. 8 hrs | 80° C. Water | 215° C. 16 hours |
| 1 | 525° C. 8 hrs | 80° C. Water | 215° C. 4 hours |
| 2 | 525° C. 4 hrs | 80° C. Water | 215° C. 150 mins |
| 3 | 525° C. 8 hrs | 80° C. Water + Aquaquench | 215° C. 4 hours |

TABLE 2-continued

| T6 Heat Treatments Evaluated | | | |
|---|---|---|---|
| Heat Treatment No. | Solution Treatment | Quench Type | Ageing |
| 4 | 525° C. 8 hrs | Air | 215° C. 4 hours |
| 5 | 525° C. 8 hrs | 80° C. Water + Aquaquench | 215° C. 8 hours |
| 6 | 525° C. 8 hrs | 80° C. Water + Aquaquench | 215° C. 150 mins |
| 7 | 525° C. 4 hrs | 80° C. Water + Aquaquench | 215° 4 hours |

The following conclusions were drawn from analysis of the results.

Micrographs showed that Comparative Composition B had the greatest amount of intermetallic phase at the grain boundaries and triple points, which is consistent with it having the highest total rare earth content. Comparative Composition C and Inventive Composition 1 had the least amounts of intermetallic phase, which is also consistent with them having a low total rare earth content. Micrographs of Inventive Composition 2 clearly showed a much larger and more variable grain size than any of the other compositions. This may be due to the slightly lower Zr content of this composition. All six compositions had the clouds of precipitates located approximately at the centre of the grains which are described elsewhere in this specification as being a Zr—Zn compound.

Hardness measurements were carried out and Inventive Compositions 1 and 2 were consistently as good as or better than Inventive Composition 3, indicating that Zn levels of 0.4–0.6 wt % are acceptable. Comparative Composition C gave consistently low hardness values, indicating that the combination of high Zn and low rare earth is less suitable. Comparative Compositions A and B were very similar to the Inventive Compositions, which could indicate that the deleterious effect of a high Zn content can be compensated for by very high rare earth contents. However, this is commercially unattractive because of the high cost of rare earth metals.

The tensile properties were determined at room temperature, 100° C., 150° C. and 177° C. The composition variants were chosen so that the effects of several interactions could be investigated, and the following observations have been made.

Inventive Composition 1, which is similar to Inventive Composition 3 in Nd content but lower in Zn and other rare earth elements, has mechanical properties as good as or better than Inventive Composition 3, indicating that a low Zn and/or rare earth content is not necessarily detrimental to mechanical properties.

Comparative Composition A and Inventive Composition 1 have very similar low Zn contents, whilst Comparative Composition A has a lower Nd content, a higher other rare earth content and a higher total rare earth content. At room temperature Inventive Composition 1 had the better proof stress and slightly higher elongation, which is consistent with there being extra Nd to provide strengthening and less Ce/La grain boundary intermetallic phase. At elevated temperature the room temperature trend was maintained.

Inventive Compositions 1 and 2 and Comparative Composition C were compositionally very similar except for Zn content which was higher in Comparative Composition C. Comparative Composition C had slightly higher Nd and other rare earth contents than Inventive Compositions 1 or 2. At both room and elevated temperatures it was found that as the Zn content was increased the proof stress decreased and the elongation increased. The most significant drop in proof stress occurred between 0.4 and 0.67% Zn.

Comparative Compositions B and C both had very similar (high) Zn contents with Comparative Composition B having a higher total rare earth content (from higher Nd and higher Ce/La) than Comparative Composition C. Comparative Composition B was consistently better than Comparative Composition C in terms of both proof stress and elongation at all temperatures; two properties which have a significant effect on creep behaviour.

Creep tests were carried out on all compositions at a constant load of 90 MPa and at temperatures of 150° C. and 177° C. The steady state creep rates are listed in Table 3.

TABLE 3

| | Steady State Creep Rates ($s^{-1}$) | |
|---|---|---|
| | 90 MPa 150° C. | 90 MPa 177° C. |
| Comparative Composition A | $7.05 \times 10^{-11}$ | $3.6 \times 10^{-10}$ |
| Comparative Composition B | $2.66 \times 10^{-11}$ | $1.67 \times 10^{-10}$ |
| Comparative Composition C | $4.07 \times 10^{-11}$ | $2.5 \times 10^{-10}$ |
| Inventive Composition 1 | $5.56 \times 10^{-11}$ | $5.31 \times 10^{-10}$ |
| Inventive Composition 2 | $2.59 \times 10^{-11}$ | $3.6 \times 10^{-10}$ |
| Inventive Composition 3 | $2.80 \times 10^{-11}$ | $1.40 \times 10^{-10}$ |

The stress to give a value of 0.1% creep strain after 100 hours is often quoted when comparing various creep resistant magnesium alloys. None of the six compositions had creep strains of this order after 100 hours at 150° C. and 90 MPa. Similarly, at 177° C., no composition exceeded this value after 100 hours, although creep strains in excess of that were reached at much longer test times. At 150° C. all six compositions would be acceptable in terms of their creep behaviour.

The zinc effect noticed in the tensile results was also evident in the creep results at 150° C., particularly with respect to the primary creep extension where Inventive Composition 1 was better than Inventive Composition 2, which was in turn better than Comparative Composition C. The secondary creep rates were similar in these three compositions. Comparative Composition B, which had the highest Zn content but also a high rare earth content was also acceptable, indicating again that the deleterious effects of the high Zn content can be counteracted by high rare earth contents.

Comparative Composition A had a higher primary response than Inventive Composition 1 and a slightly higher steady state creep rate, which indicates that although a Nd level of 1.4% is acceptable, 1.5% would be a preferable minimum and 1.6% even more preferable.

EXAMPLE 2

Experimental Procedure

Samples of an alloy designated SC1 (96.3% Mg, 1.7% Nd, 1.0% RE (Ce:La of ~70:30), 0.5% Zn and 0.5% Zr) were prepared from gravity cast stepped plates, as shown in FIG. 1. The Ce and La were added as a Ce-based misch metal which also contained some Nd. The extra Nd and the Zn were added in their elemental forms. The zirconium was added through a proprietary Mg—Zr master alloy. The mechanical properties presented here were determined from samples cut from the 15 mm step, where the grain size achieved was approximately 40 μm. Standard melt handling procedures and controlled environment heat treatment conditions were used throughout the preparation of the cast plates.

MICROSTRUCTURE—Samples for metallographic examination were polished with diamond pastes to 1 μm followed by 0.05 μm colloidal silica. Etching was carried out in a solution of nitric acid in ethylene glycol and water for approximately 12 seconds.

Figure 2A:
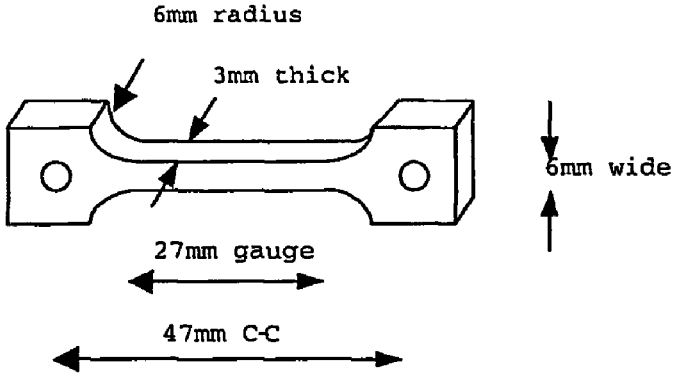
Figure 2B:
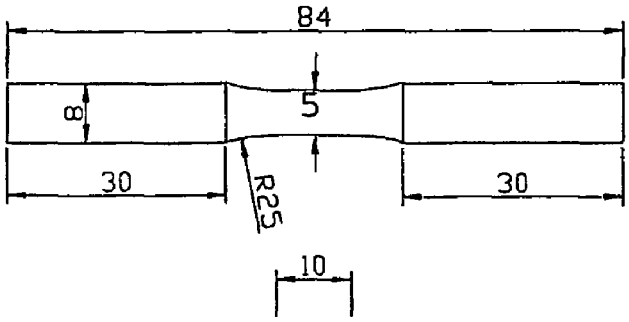

TENSION AND COMPRESSION TESTS—The tensile properties were measured in accordance with ASTM E8 at 20, 100, 150 and 177° C. in air using an Instron Testing Machine. Samples were held at temperature for 10 minutes prior to testing. The test specimens had a rectangular cross section (6 mm×3 mm), with a gauge length of 25 mm (FIG. 2(*a*)). The compressive yield strength was determined in accordance with ASTM E9 at the same temperatures using cylindrical samples 15 mm in diameter and 30 mm long. The elastic modulus of the alloy was determined at room and elevated temperatures using a Piezoelectric Ultrasonic Composite Oscillator Technique (PUCOT) [Robinson, W H and Edgar A *IEEE Transactions on Sonics and Ultrasonics*, SU-21(2) 1974 98–105].

CREEP TESTS—The creep behaviour was determined on constant load machines at temperatures of 150 and 177° C. and stresses of 46, 60, 75 and 90 MPa, in temperature controlled silicone oil baths. The test samples were the same geometry as those used in the tensile testing, and the extension during creep was measured directly from the gauge lengths of the samples.

FATIGUE TESTS—The fatigue strengths at $10^6$ and $10^7$ cycles were determined at 25 and 120° C. in air. The specimens had a circular cross-section, 5 mm in diameter and a 10 mm gauge length (FIG. 2(*b*)), polished to 1 μm finish which corresponds approximately to the surface finish at the main bearing—the most highly stressed part of an engine block. Specimens were loaded axially in fully reversed tension-compression (ie. at zero mean stress) and the test frequency was 60 Hz, corresponding to nominal service conditions. There are several procedures for assessing the fatigue strength at a given life and here the staircase method was used (BS 3518 Part 5).

Figure 3:
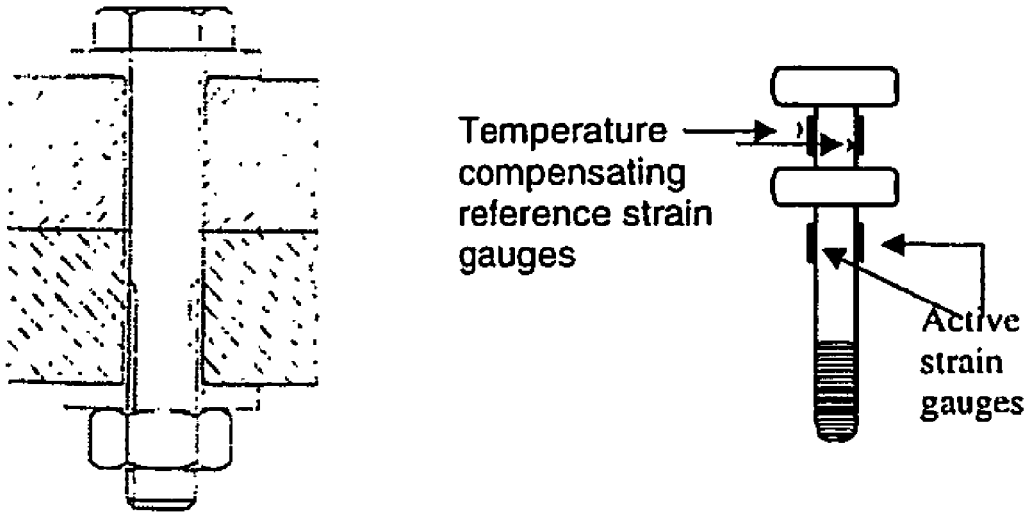

BOLT LOAD RETENTION (BLR) TESTS—Bolt load retention testing can be used to simulate the relaxation that may occur in service under a compressive loading. The test method [Pettersen K and Fairchild S *SAE Technical Paper* 970326] involves applying an initial load (in this case 8 kN) through an assembly consisting of two identical bosses, 15 mm thick and 16 mm outside diameter, made of the test material and a high strength M8 bolt instrumented with strain gauges (FIG. 3). The change in load over 100 h at an elevated temperature (150° C. and 177° C.) is measured continuously. The two significant loads, in terms of defining the BLR behaviour, are the initial load at ambient temperature, $P_I$, and the load at the completion of the test after returning to ambient conditions, $P_F$. The ratio of these two values ($P_F/P_I$) is a measure of the bolt load retention behaviour of an alloy. There is often an initial increase in load as the bolted assembly is heated to the test temperature. This is the result of the combined thermal expansion of the bolted assembly and the yield deformation in the alloy bosses.

THERMAL CONDUCTIVITY—The thermal conductivity was measured on samples 30 mm in diameter and 30 mm long.

CORROSION RESISTANCE—The corrosion resistance of SC1 was compared to that of AZ91, using standard saline immersion tests at room temperature. The tests were carried out over a period of seven days in a saline environment (3.5% NaCl solution) with the pH stabilised to 11.0 using 1M NaOH solution. The corrosion products were removed from the test coupons using a chromic acid wash followed by an ethanol rinse.

Results and Discussion

Figure 4:
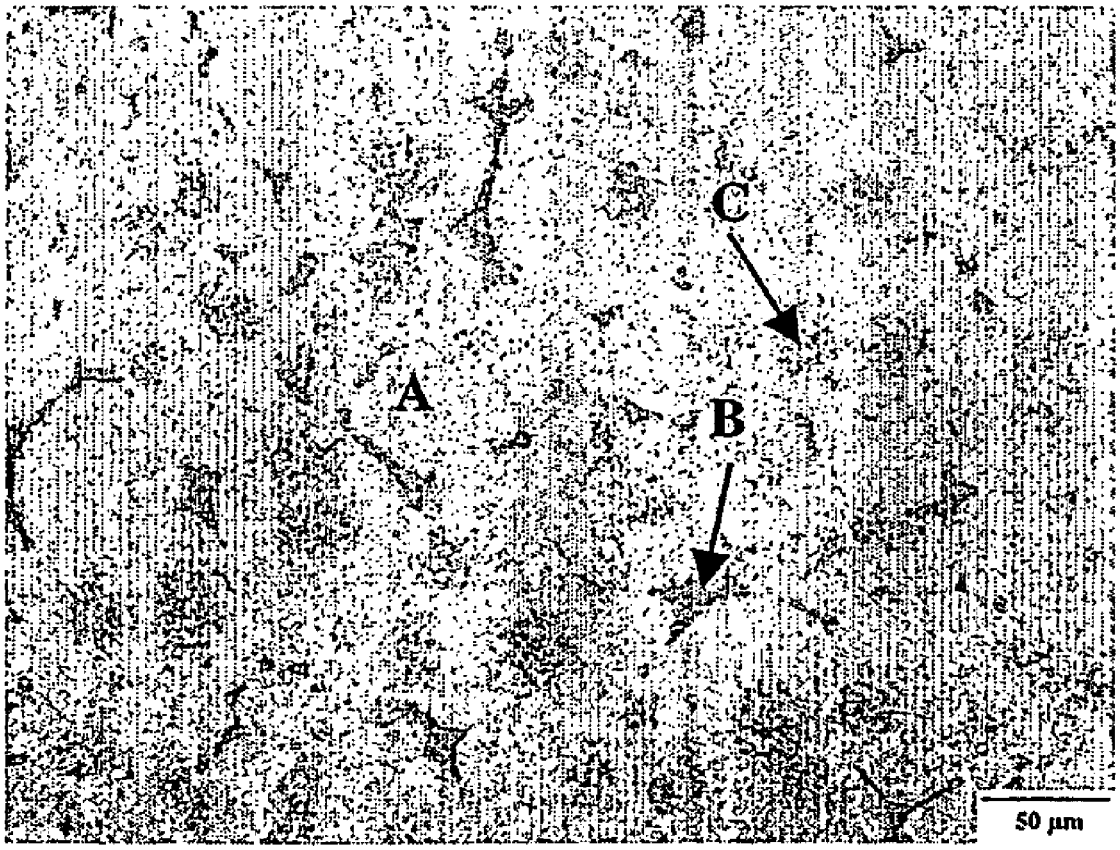

MICROSTRUCTURE—Being a sand casting alloy, SC1 requires a T6 treatment (solution heat treatment in a controlled atmosphere, cold or warm water quench, and elevated temperature anneal) to fully develop its mechanical properties. The recommended heat treatment regime is a balance between mechanical property requirements and commercially acceptable holding times after casting. The T6 microstructure of SC1, which is shown in FIG. 4, consists of grains of an α-Mg phase (A) locked by a magnesium-rare earth intermetallic phase (B) at grain boundaries and triple points. Clusters of rod-like precipitates (C) are present within the central regions of most grains. The intermetallic phase, B, has a stoichiometry close to $Mg_{12}(La_{0.43}Ce_{0.57})$.

Figure 5A:
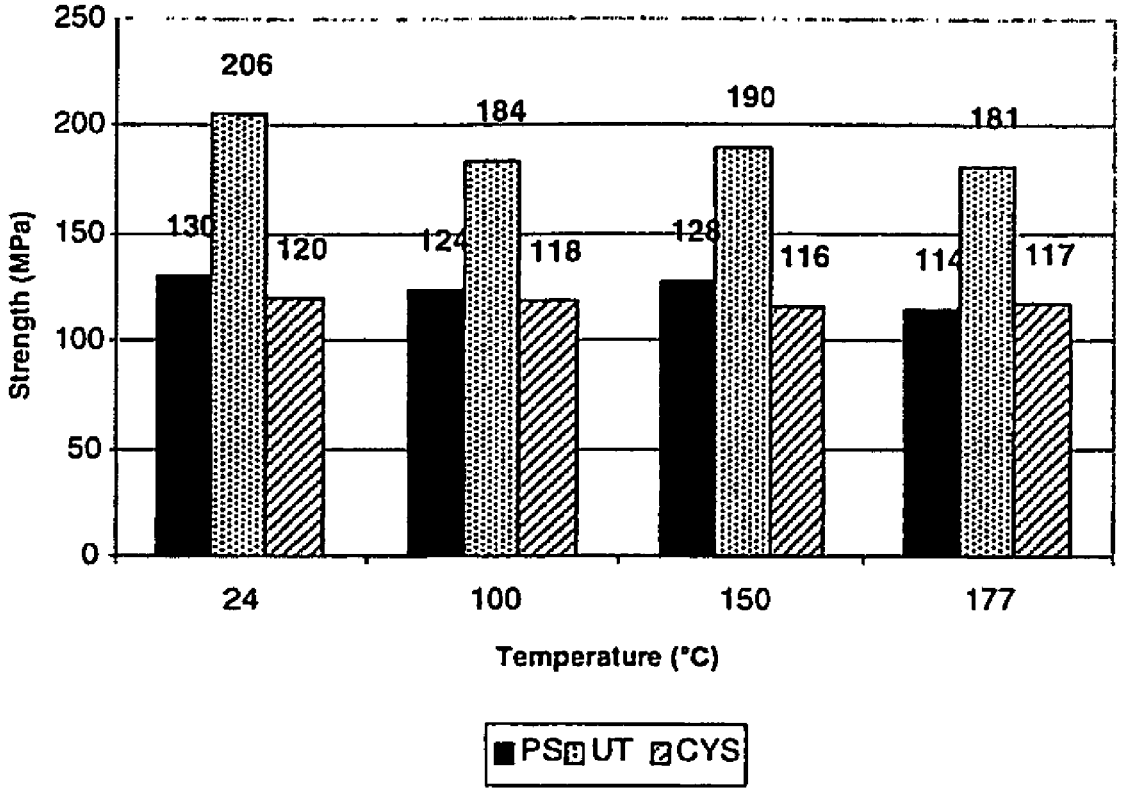
Figure 5B:
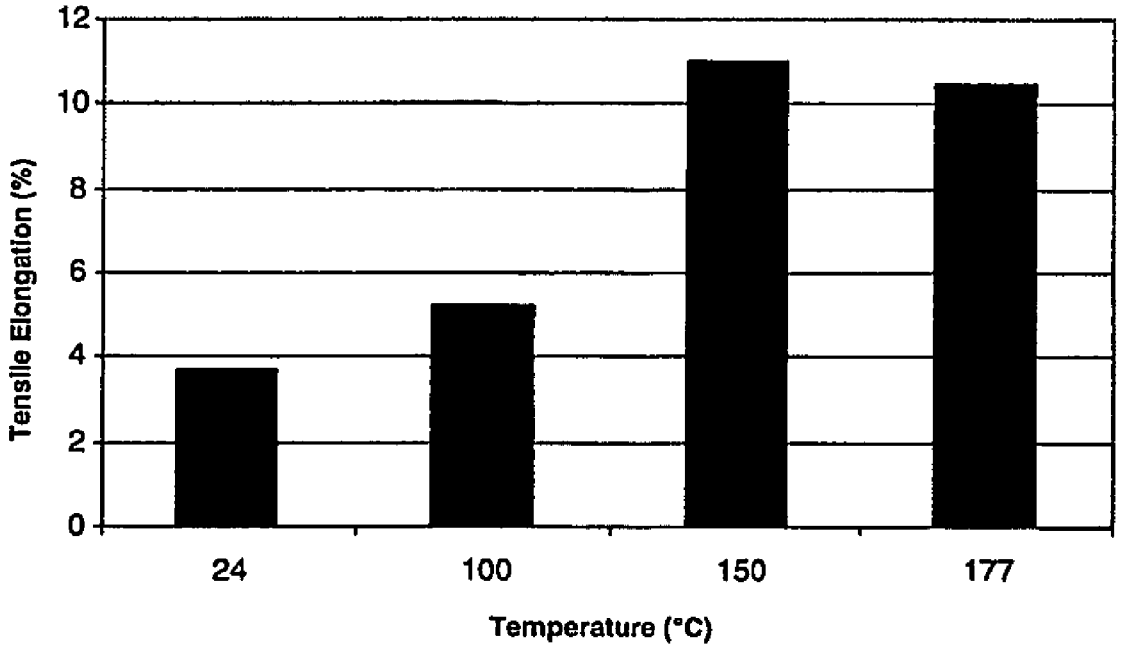

TENSILE AND COMPRESSIVE STRENGTHS—FIG. 5(*a*) shows both the tensile properties (the 0.2% proof strength and the ultimate tensile strength) and the compressive yield strength as a function of temperature. FIG. 5(*b*) shows the tensile elongation, also as a function of temperature. It is significant to note that the mechanical properties of SC1 are extremely stable at elevated temperatures, with the proof strengths in both tension and compression being relatively unchanged between room temperature and 177° C. The room temperature properties of SC1 are nowhere near as high as most other magnesium sand casting alloys but it is the stability of these properties up to 177° C. which makes this alloy particularly attractive for engine block applications.

The results of the elastic modulus determination are shown in Table 4, and it is of note that the elastic modulus shows a drop of less than 10% at 177° C. over the room temperature value.

TABLE 4

Elastic Modulus of SC1 as determined using a PUCO technique.

| Young's Modulus (GPa) | | |
|---|---|---|
| 25° C. | 100° C. | 177° C. |
| 45.8 ± 0.3 | 43.9 ± 0.3 | 41.9 ± 0.3 |

Figure 6:
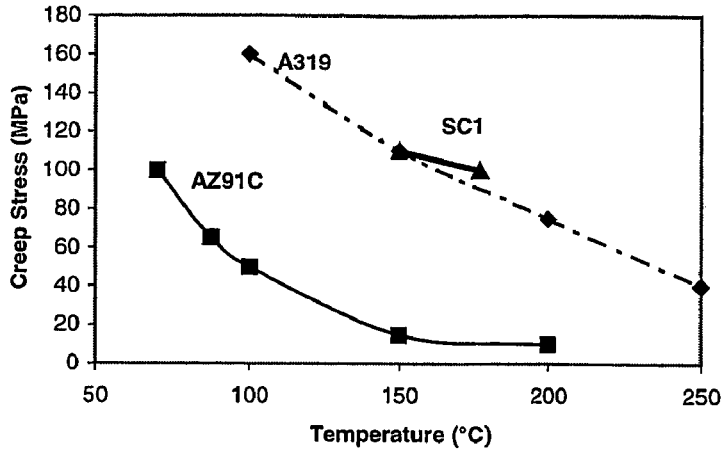

CREEP AND BOLT LOAD RETENTION BEHAVIOUR—The microstructure of SC1 is extremely stable at temperatures up to 177° C., and this is an important factor, together with the form and distribution of the grain boundary intermetallic phase, in achieving the requisite creep resistance. The use of a creep stress, being the stress to produce a creep strain of 0.1% after 100 hours at temperature, as a measure of creep resistance is an arbitrary one, but it is nonetheless a useful method for comparing alloy behaviour. Using this concept, the behaviour of SC1 may be compared to that of A319 (FIG. 6) and it is clear that the two alloys are very similar in their creep responses in the temperature range 150 to 177° C. More importantly, however, it should be noted that the stresses required to produce a creep strain of 0.1% in SC1 after 100 hours at both 150 and 177° C. are approaching the tensile yield strengths (0.2% offset) of the material.

Figure 7A:
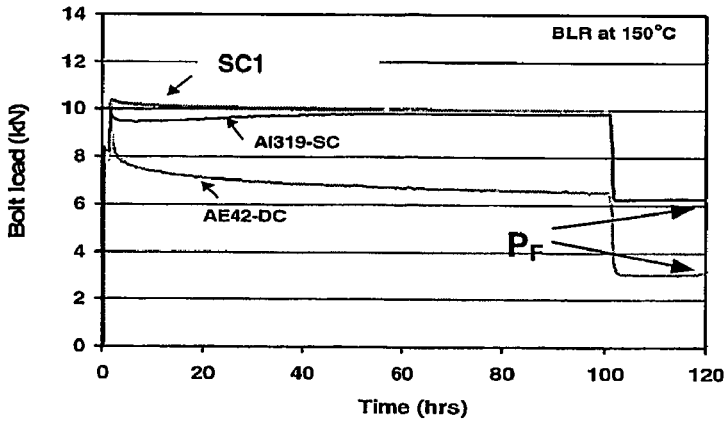
Figure 7B:
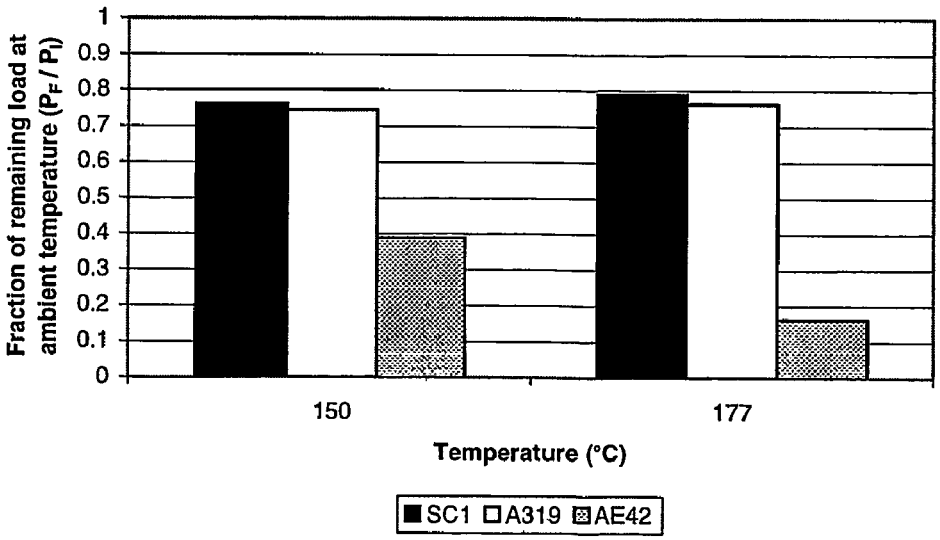

Typical bolt load retention curves for SC1, A319 and AE42 at 150° C. and 8 kN load are shown in FIG. 7(*a*). SC1 is in the T6 condition, A319 is as sand cast and AE42 is high pressure die cast (ie. all three alloys are in their normal operating condition). The increase in load occurring at the commencement of the test is the net result of the thermal expansion of the bolted assembly less the yield deformation in the alloy bosses. Two significant loads are the initial load at ambient temperature, $P_I$ (8 kN in this case), and the load at the completion of the test after returning to ambient conditions, $P_F$. The ratio of these two values is taken as a measure of the bolt load retention behaviour of an alloy, and has been used in this case to compare SC1 with die cast AE42 at 150 and 177° C. (FIG. 7(*b*)). The bolt load retention behaviour at elevated temperatures again reflects the high temperature stability of this alloy and it is clear that SC1 is as good as the aluminium alloy A319 and superior to AE42 in this respect.

FATIGUE PROPERTIES—An engine block is continually subjected to cyclic stresses during service and it is necessary, therefore, to ensure that the material chosen for the block can withstand this fatigue loading. The fatigue strengths of SC1 at $10^6$ and $10^7$ cycles were determined at both 24 and 120° C., and the figures quoted in Table 5 are the stresses giving a 50% probability of fracture. The limits represent the stresses for the 10% and 90% probabilities of fracture. It should be noted that these results are for a maximum of $10^7$ cycles, rather than the $5\times10^7$ specified in the design criteria. Nonetheless, the strengths are sufficiently high for the alloy to be considered to have met the target.

TABLE 5

Fatigue Strengths of SC1 at two temperatures (R = −1).

| Temperature | Fatigue Strength (MPa) $10^6$ cycles | Fatigue Strength (MPa) $10^7$ cycles |
|---|---|---|
| 24° C. | ~80 | 75 ± 18 |
| 120° C. | 74 ± 9 | 71 ± 7 |

~denotes 12 samples only tested, rather than the 15 required by the standard

CORROSION—The corrosion behaviour of the alloy, both internally and externally, is of paramount importance. Corrosion on the internal surfaces may be controlled by the use of an appropriate engine coolant combined with careful design to ensure compatibility of all the metal components in contact with the coolant liquid. The corrosion resistance of the external surfaces will depend to a large extent on the composition of the alloy itself. There is no one test which can determine the corrosion resistance of an alloy in all environments and therefore SC1 has been compared to AZ91 using a standard saline immersion test. Both the alloys were in the T6 heat treated condition, and the mean weight loss rates over this time were found to be 0.864 mg/cm$^2$/day for SC1 and 0.443 mg/cm$^2$/day for AZ91E.

THERMAL CONDUCTIVITY—The thermal conductivity of SC1 was found to be 102 W/mK, which is slightly less than that originally specified in the design criteria. However, with this information available, it is not difficult to modify the design of an engine block to accommodate this thermal conductivity value.

Conclusion

SC1 is able to meet the following specifications:

0.2% proof strength of 120 MPa at room temperature and 110 MPa at 177° C.

Creep resistance comparable to that of A319 at temperatures of 150° C. and 177° C.

Fatigue limit in excess of 50 MPa at room temperature.

This combination of superior elevated temperature mechanical properties and calculated cost effectiveness suggests SC1 would make a commercially viable option as an engine block material.

In the claims which follow and in the preceding description of the invention, except where the context requires otherwise due to express language or necessary implication, the word "comprise" or variations such as "comprises" or "comprising" is used in an inclusive sense, ie. to specify the presence of the stated features but not to preclude the presence or addition of further features in various embodiments of the invention.

It is to be clearly understood that although prior art publication(s) are referred to herein, this reference does not constitute an admission that any of these documents forms part of the common general knowledge in the art in Australia or in any other country.

The invention claimed is:

1. A magnesium based alloy consisting of, by weight:
1.4–1.9% neodymium,
0.8–1.2% rare earth element(s) with atomic number(s) 57–71, other than neodymium,
0.4–0.7% zinc,
0.3–1% zirconium,
0–0.3% manganese, and
0–0.1% oxidation inhibiting element(s) the remainder being magnesium except for incidental impurities.

2. An alloy as claimed in claim 1 wherein the magnesium content is 95.5–97% by weight.

3. An alloy as claimed in claim 1 wherein the neodymium content is 1.6–1.8% by weight.

4. An alloy as claimed in claim 1 wherein the content of rare earth(s) other than neodymium is 0.9–1.1% by weight.

5. An alloy as claimed in claim 1 which contains a plurality of rare earth elements with atomic numbers 57–71, other than neodymium and in which cerium comprises over half the weight of the rare earth elements other than neodymium.

6. An alloy as claimed in claim 1 wherein the zirconium content is greater than 0.4% by weight.

7. An alloy as claimed in claim 1 wherein the zinc content is 0.4–0.6% by weight.

8. A method of producing a magnesium alloy article, the method comprising the step of subjecting to a T6 heat treatment an article cast from an alloy as claimed in claim 1.

9. An engine block for an internal combustion engine produced by a method as claimed in claim 8.

10. A method of manufacturing a magnesium alloy article, the method comprising the steps of:
(a) solidifying in a mould a casting of an alloy as claimed in claim 1,
(b) heating the solidified casting at a temperature of 500–550° C. for a first period of time,
(c) quenching the casting, and
(d) ageing the casting at a temperature of 200–230° C. for a second period of time.

11. A method of manufacturing a casting made from magnesium alloy comprising the steps of:

(i) melting an alloy as claimed in claim 1 to form a molten alloy, (ii) introducing the molten alloy into a sand mould or permanent mould and allowing the molten alloy to solidify, (iii) removing the resultant solidified casting from the mould, and (iv) maintaining the casting within a first temperature range for a first period of time during which a portion of an intergranular phase of the casting is dissolved, and subsequently maintaining the casting within a second temperature range lower than the first temperature range for a second period of time during which nano-scale precipitate platelets are caused to precipitate within grains of the casting and at grain boundaries.

12. A method as claimed in claim 11 wherein the first temperature range is 500–550° C., the second temperature range is 200–230° C., the first period of time is 6–24 hours, and the second period of time is 3–24 hours.

13. An engine block for an internal combustion engine formed from a magnesium alloy as claimed in claim 1.

* * * * *